US005230262A

United States Patent [19]

Ahlund et al.

[11] Patent Number: 5,230,262

[45] Date of Patent: Jul. 27, 1993

[54] RATCHET WRENCH

[75] Inventors: Bengt Ahlund, Enköping; Hakan Bergqvist; Hans Himbert, both of Bromma; Conny Jansson, Enköping, all of Sweden

[73] Assignee: AB Sandvik Bahco, Sweden

[21] Appl. No.: 858,117

[22] Filed: Mar. 26, 1992

[30] Foreign Application Priority Data

Mar. 27, 1991 [SE] Sweden ..... 9100924

[51] Int. Cl.[5] ..... B25B 13/46

[52] U.S. Cl. ..... 81/63.2

[58] Field of Search ..... 81/60–63.2

[56] References Cited

U.S. PATENT DOCUMENTS 685,698 10/1901 Sprague .
893,097 7/1908 Reams ..... 81/63
1,177,764 4/1916 Dodge .
4,869,138 9/1989 Farris ..... 81/63.2 X

FOREIGN PATENT DOCUMENTS 1538615 9/1968 France .
254498 7/1927 Italy ..... 81/63.2
2223971A 10/1988 United Kingdom .

*Primary Examiner*—D. S. Meislin
*Attorney, Agent, or Firm*—Klarquist, Sparkman, Campbell, Leigh & Whinston

[57] ABSTRACT

A ratchet wrench comprises a handle (2) in which a ratchet spring (1) extends axially between the wrench head at one end of the handle and a gripping sleeve (4) at the other end thereof. The gripping sleeve carries a rotatable or twistable resetting sleeve (3) by means of which the ratchet spring can be adjusted between two predetermined positions so as to activate a ratchet device mounted in the wrench head. The ratchet spring has a hairpin-like bend whose one leg (22) engages the resetting sleeve while the other leg (21) thereof can be snapped around a shoulder (8) located on the bottom of 15 an operating chamber (7) located within the gripping sleeve. The axial extension of the other leg finds correspondence in the crank (11) formed by the ratchet spring in the transition to the wrench head. The crank engages in and adjusts the ratchet device, thereby enabling the direction in which the ratchet wrench can return freely to be reversed.

11 Claims, 3 Drawing Sheets

RATCHET WRENCH

TECHNICAL FIELD

The present invention relates to a ratchet wrench or spanner of the kind which comprises a handle having mounted on one end thereof a ratchet head which accommodates a rotatable mechanism. The direction of rotation of the mechanism can be adjusted by means of a ratchet device, and the other end of the handle is provided with a grip surface for facilitating manual operation of the ratchet wrench.

BACKGROUND ART

Ratchet wrenches of the aforesaid kind are known generally. The ratchet device used with the most common type of ratchet wrench available today is located in the immediate vicinity of the rotatable mechanism. Naturally, it is highly impracticable for the fitter in having the ratchet device positioned away from the handle gripping surface, since this would either force the fitter to release his grip on the handle in order to reset the ratchet device when wishing to rotate or turn the wrench in an opposite direction, or to reset the ratchet device with his other hand (which is often used to support or to grip the work in progress in some other way).

In recent times, ratchet wrenches have been introduced with which a ratchet-device operating-element is provided on the wrench handle, more or less in the vicinity of the handle gripping surface. In this case, the operating element has the form of a button which can be moved in the direction of the handle axis. This button is intended to be operated with the thumb of the hand used to grip the handle gripping surface, and although having solved the problem of needing to lift a hand in order to reset the ratchet device, the button device is still not an optimal manoeuvering device when seen from an ergonomical aspect. In order to satisfy any such requirement, it is necessary to reconstruct the whole of the ratchet wrench in a qualified fashion.

DISCLOSURE OF THE INVENTION

Penetrative studies as to how ratchet wrenches are manoeuvered in different situations have established that the wrench handle, and particularly its gripping surface, shall preferably have a generally round cross-section. In order to achieve optimum ergonometry, the means used to reset the rotational direction of the rotatable mechanism of the ratchet wrench shall have a form which is well adapted to the gripping surface and which is located in the immediate vicinity of said gripping surface.

This is achieved with the inventive ratchet wrench, in that a rotatable device is provided on the wrench handle, and connected to the operating element used to reset the ratchet device.

According to one preferred embodiment of the inventive ratchet wrench, the rotatable device has the form of a sleeve situated in the immediate vicinity of or within the gripping surface of the handle, and the manoeuvering element is arranged to move along the handle, in its longitudinal direction. A recess is preferably provided in the handle to accommodate the manoeuvering element, which includes a ratchet spring. One end of the ratchet spring engages the ratchet device at the head of the handle and the opposite end of the spring has the form of a hairpin-shaped element which is connected to the sleeve.

The sleeve can be advantageously rotated about the longitudinal axis of the handle, between two end positions. Rotation of the sleeve activates the hairpin-like element of the ratchet spring, said element being mounted for movement over a shoulder provided on the bottom of a chamber which forms part of the recess formed in the handle. The hairpin-like element thus has a bistable function, in that the element has two rest positions, one on each respective side of the aforesaid shoulder. When the hairpin-like element passes from one rest position to the other, the ratchet spring is rotated so that a crank-like part of the element which engages the ratchet device functions to reset said device.

The ratchet device of the inventive ratchet wrench has per se a configuration which enables the inventive ratchet wrench to be given an optimal ergonometrical design. In the case of the preferred embodiment of the inventive ratchet wrench, the ratchet device is accommodated in a ratchet chamber provided in the handle head. The ratchet chamber is open towards a wheel chamber in which a ratchet wheel is journalled, together with the rotatable mechanism. Rotation of the ratchet wheel is always latched by means of the ratchet device in one direction relative to the handle while permitting rotation of said wheel in the opposite direction. The ratchet device can be adjusted between two ratchet positions, corresponding to the bistable positions of the hairpin-like element of the ratchet spring.

In the case of the preferred embodiment of the inventive ratchet wrench, the ratchet wheel has a toothed peripheral surface in which the ratchet device engages. The ratchet device conveniently has a kidney-shaped body whose surface is intended to engage with the ratchet wheel and the radius of curvature of which corresponds to the radius of the ratchet wheel, whereas the opposite surface of the body has a smaller radius of curvature and is intended to coact with two mutually opposite walls of the ratchet chamber. The radius of curvature of said opposing walls of the ratchet chamber coincide with the convex radius of curvature of the ratchet device. The convex radius of curvature of the ratchet device merges with an inwardly angled straight line at both ends.

Because the crank part of the ratchet spring is rotatably journalled directly in the ratchet body, the ratchet body can be immediately snapped to another setting by commensurate rotation of the gripping surface sleeve.

DESCRIPTION OF PREFERRED EMBODIMENTS

An exemplifying embodiment of the inventive ratchet wrench will now be described in more detail with reference to the accompanying drawings, in which FIG. 1 is a top view of the basic body structure of the preferred embodiment of an inventive ratchet wrench, this basic body structure forming the handle and head of the ratchet wrench;

Figure 1:
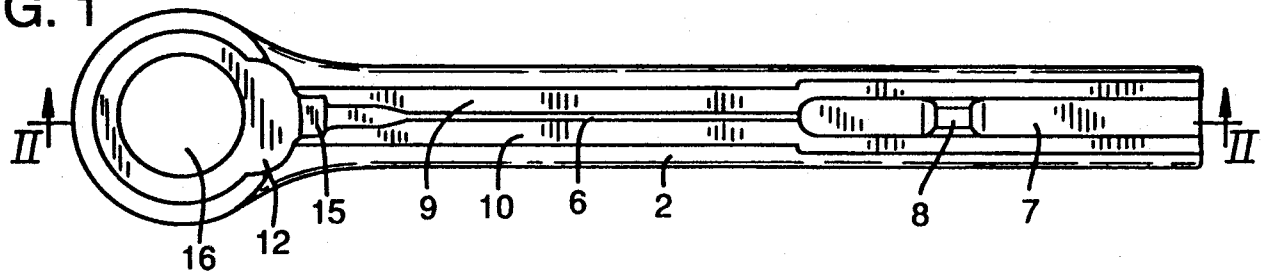
Figure 2:
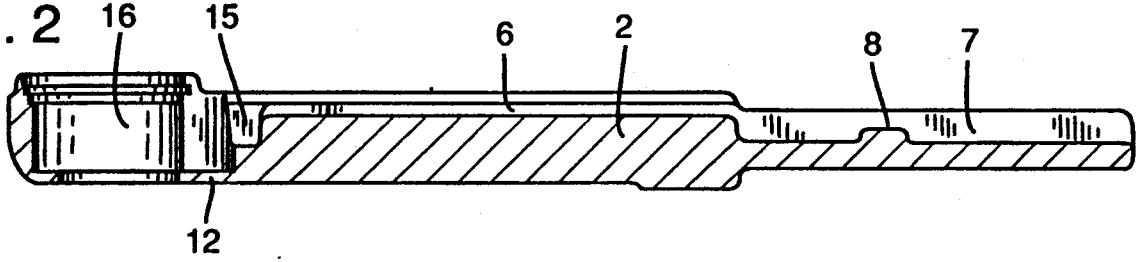
FIG. 2 is a longitudinal section view of the basic body structure taken on the line II—II in FIG. 1.

The ratchet wrench according to the preferred embodiment of the present invention is constructed around a base body structure, illustrated in FIGS. 1 and 2. The basic body structure has the form of a handle 2 which is terminated at one end with a head 12. Extending along the handle 2 is a recess 6 which merges with a crank chamber 15 in the vicinity of the head 12 and with an operating chamber 7 at the opposite, hand-grip end of the handle. The recess 6 forms journalling means for an operating element which, in the preferred embodiment, has the form of a ratchet spring 1 which is movable between two distinct rest or terminal positions. These rest positions are defined by a shoulder 8 located on the bottom surface of the operating chamber 7, as described in more detail here below with reference to FIGS. 3 and 4. The crank chamber 15 located adjacent the head 12 of the wrench connects with a wheel chamber 16 whose main axle is generally perpendicular to the longitudinal axis or main of the handle 2 and which forms a through-passing hole that extends from the upper surface of the head 12 and out through its bottom surface. The wheel chamber 16 is intended to form journalling means for a rotatable ratchet wheel 14, as described below in more detail with reference to FIGS. 7 and 8.

Figure 3:
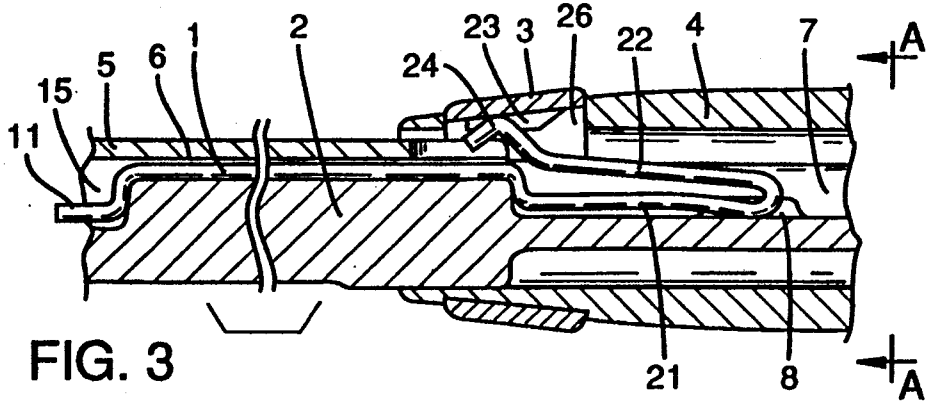
FIG. 3 is a sectional view corresponding to the view of FIG. 2, taken through parts of the assembled inventive ratchet wrench.

Illustrated to the left of FIG. 3 is the transition part of the shaft 2 to the wrench head (not shown) while illustrated to the right of FIG. 3 is the hand grip-end of the handle 2. As shown in the Figure, the ratchet spring 1 is journalled in the recess 6 beneath a cover plate 5 which extends from the wheel chamber 16 (FIGS. 1 and 2) and closes the crank chamber 15 and the recess 6 and terminates at the operation chamber 7. The cover plate 5 rests against the planar surfaces 9, 10 located around the recess 6 (FIG. 1), said plate being preferably secured to said surfaces with the aid of screws or some other appropriate fastener (not shown).

The handgrip-end of the handle 2 carries an ergonomically configured gripping sleeve 4 which is provided with a well-shaped gripping surface suited to the hand of the person using the wrench. The gripping sleeve 4 extends axially in the longitudinal direction of the handle 2 along the whole of the operation chamber 7 and continues a short distance in over the recess 6. The end of the gripping sleeve 4 located adjacent the recess 6 carries a partially rotatable resetting sleeve 3. The resetting sleeve 3 can thus be rotated around the longitudinal axis of the handle 2, between two end positions which are determined by mutually coacting stop means (not shown) mounted on the resetting sleeve-attachment means and in the gripping sleeve 4. These two end positions correspond to the two distinct rest positions of the ratchet spring 1.

Figure 7:
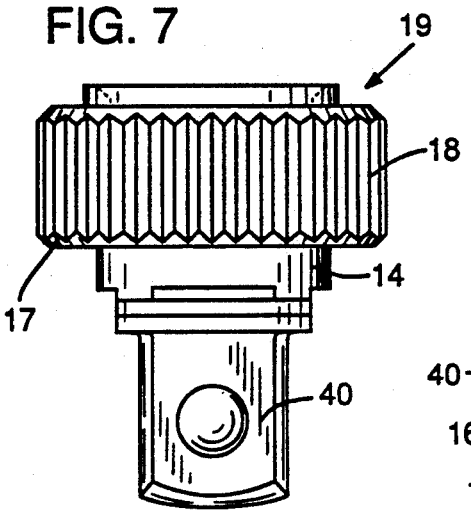
FIG. 7 is a top view of the rotatable mechanism and its ratchet wheel accommodated in the wrench head.

The end of the ratchet spring 1 which projects into the crank chamber 15 has the form of a crank 11 which is intended to coact with a ratchet device 13, or pawl means as described in more detail herebelow with reference to FIGS. 7 and 8. That part of the spring 1 which projects into the operating chamber 7 has a hairpin-like fold from which two legs 21, 22 extend. The one leg 21 is guided generally along the bottom of the chamber 7 up to the shoulder means 8 provided on said chamber bottom, where said one leg 21 merges with the other leg 22, which extends back through the chamber 7 above the first leg 21 and coacts with the resetting sleeve 3. The leg 21 and the crank 11 may have a mutually coinciding rotational axis, whereas that part which mutually connects these parts of the ratchet spring 1 is journalled excentrically in the recess 6. The rotational axes of the crank 11 and the leg 21 are preferably located at different distances from the main rotational axis of the spring 1.

Figure 5:
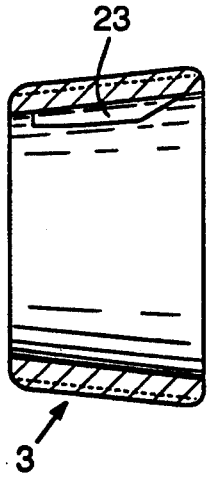
FIG. 5 is a longitudinal section view corresponding to the longitudinal section view of FIG. 3, taken through the sleeve which functions to activate the ratchet spring.
Figure 6:
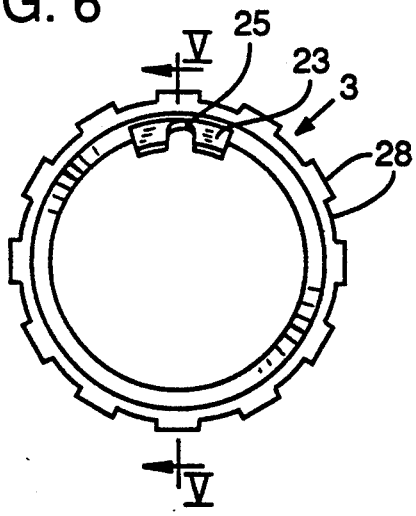
FIG. 6 illustrates the sleeve of the FIG. 5 embodiment, seen in the direction A—A in FIG. 3.

FIGS. 5 and 6 are separate views of the resetting sleeve 3. As will be seen from both FIGS. 3 and 6, the resetting sleeve 3 has the shape of a truncated cone which coincides with the terminating shape of the gripping sleeve 4 and its junction with the handle 2. Mounted on the inner surface of the resetting sleeve 3 is an attachment device 23 in which the outer end 24 of the second leg 22 of the spring 1 engages. The attachment device 23 thus has an attachment 25 for the end 24 of the spring leg 22, as shown in FIG. 5. The attachment device 23 is arranged to extend in an opening 26 in the gripping sleeve 24. Similar to the outer surface of the gripping sleeve 4, the outer surface of the resetting sleeve 3 is provided with a grip-friendly embossment pattern. As shown in FIG. 6, an appropriate surface patterning of the resetting sleeve 3 has the form of crests and troughs 28 which extend in the longitudinal direction of the sleeve.

Figure 4A:
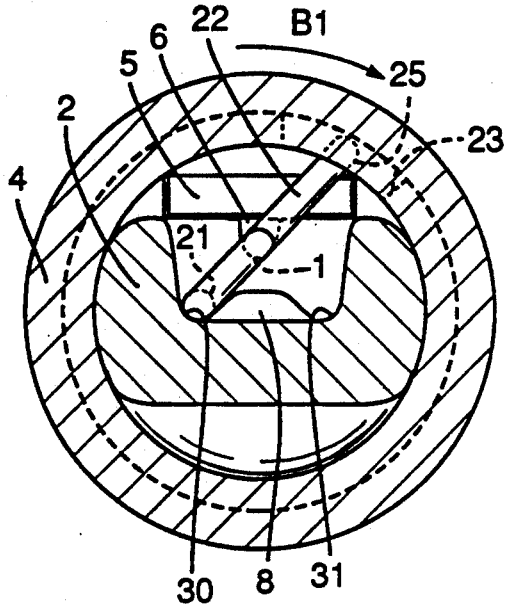
FIGS. 4A and 4B are cross-sectional views of the inventive ratchet wrench, seen in the direction A—A in FIG. 3, and showing respective settings of the ratchet spring of said wrench.
Figure 4B:
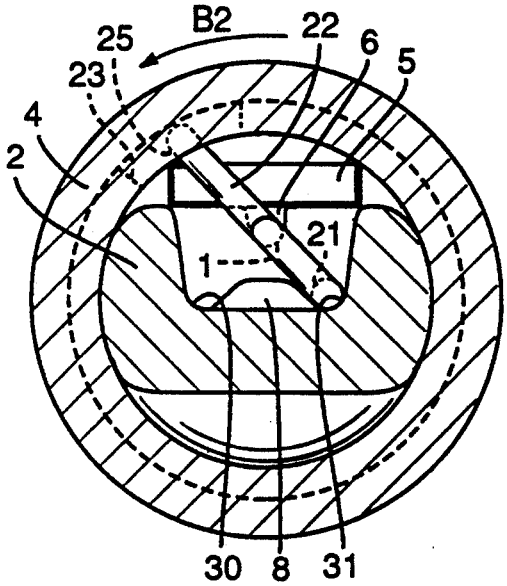

FIG. 4 illustrates the operation chamber 7 as seen from the end marked with the directional arrows A—A in FIG. 3. In this respect, FIGS. 4A and 4B illustrate respectively two possible end positions of the ratchet spring 1 in the spaces 30, 31 on either side of the should means 8. As will be seen from FIG. 4, the gripping sleeve 4 is attached to the handle 2 and the recess 6 is covered by the plate 5. As indicated by the arrows B1 and B2, the resetting sleeve 3 and its attachment device 23 for attachment of the second ratchet-spring leg 22 is rotatable, wherein rotation of the sleeve results in the leg 21 snapping over the shoulder 8 and adopting a respective end position in the spaces 30 and 31. These end positions correspond to the extent to which the resetting sleeve 3 is able to rotate.

Figure 8A:
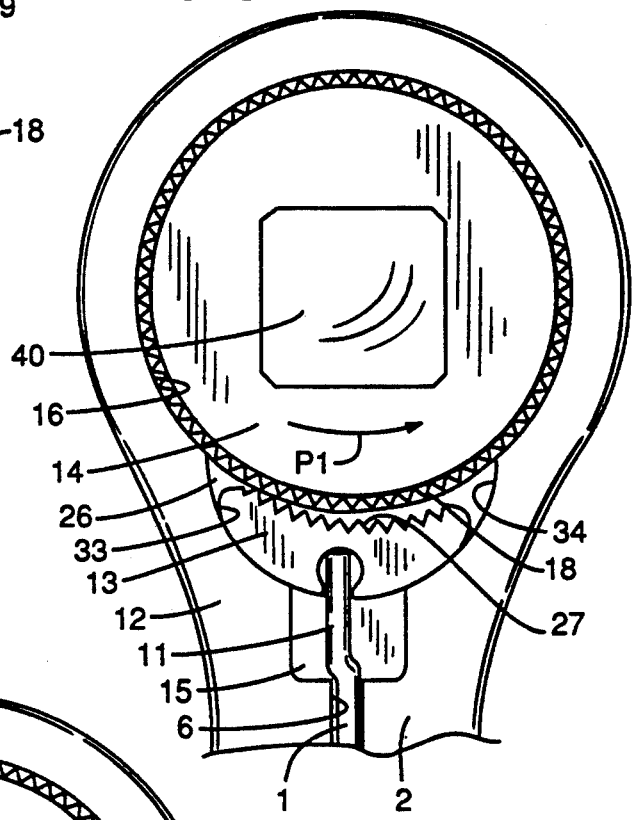
FIGS. 8A and 8B show the head end of the wrench, with the covering plate removed in order to show the ratchet device in its inoperative position and in its operative driving position respectively.

As described below with reference to FIG. 8, FIG. 4A illustrates the end position of the spring 1 when the ratchet wrench is released for return idling movement to the right (in the direction of the arrow P1 in FIG. 8A) during which idling movement the mechanism 19 (FIGS. 7 and 8) is movable relative to the handle. FIG. 4B illustrates the end position of the ratchet spring 1 when the wrench is released for corresponding return movement in the opposite direction (to the left).

Figure 8B:
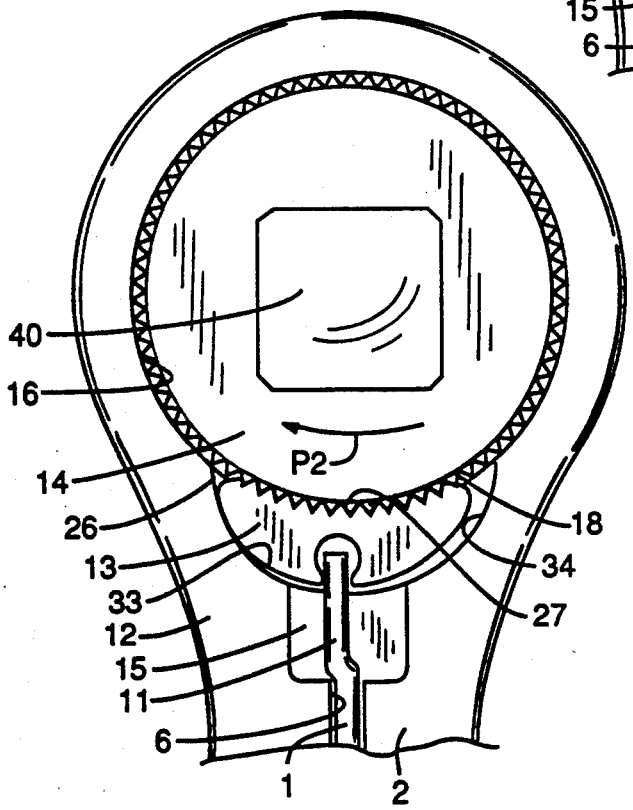

FIG. 7 is a separate view of the mechanism 19 mounted rotatably in the wheel chamber 16 of the wrench head 12 illustrated in FIGS. 1 and 2. The mechanism 19 comprises a ratchet wheel 14 which carries a tool holder or boss 40, for example in the form of a square peg onto which a suitable so-called box socket can be fitted for nut-tightening and nut-loosening purposes. The tool holder 40 is preferably connected fixably to the ratchet wheel 14 and rotates together therewith. The peripheral side surface 17 of the ratchet wheel 14 is provided with a ring of teeth 18 which preferably cover the whole of the surface 17. The number of teeth in the ring 18 should be sufficient to provide a satisfactory pitch for engagement of a ratchet device 13 or pawl means (FIG. 8) upon completion of an idling return movement. The number of teeth, however, should not be excessively large, in view of the fact that it must be possible to obtain a depth of tooth engagement or mesh sufficient to obtain the torque to be transmitted to the mechanism 19 when the wrench is rotated in its driving direction with the ratchet device 13 in its operative ratchet position (FIG. 8B). In the case of a ratchet wrench having a ratchet wheel 14 with a diameter of 30 mm, it has been found that a tooth number of between 60 and 80 is acceptable. An optimum function is achieved with 72 teeth.

FIGS. 8A and 8B show the same view of the wrench head 12 as that shown in FIG. 1, but with the ratchet wheel 14 and ratchet device 13 mounted in the wheel chamber 16 and the ratchet chamber 26 respectively. Thus, the ratchet wheel 14 is journalled in the wheel chamber 16, which connects with the crank chamber 15 via the ratchet chamber 26. The crank-part 11 of the ratchet spring 1 projecting out in the crank chamber 15 is rotatably mounted and axially displaceable in the ratchet device 13. The ratchet device 13 can be adjusted between two end positions by means of the ratchet spring 1, by rotating or twisting the resetting sleeve 3 in the aforedescribed manner, such as to bring the ratchet spring 1 into one of the positions illustrated in FIGS. 4A and 4B. FIGS. 8A and 8B show one of these two end positions, namely the position which corresponds to the spring position shown in FIG. 4A. This enables the wrench to be moved freely in a return direction indicated by the arrow P1, during which the handle 2 moves freely in relation to the mechanism 19 and its ratchet wheel 14, as illustrated in FIG. 8A. When the handle 2 is moved in the opposite direction, the ratchet wheel 14 is locked so as to accompany the rotational movement in the direction of the arrow P2 shown in FIG. 8B, during which the mechanism 19 carries out a rotational movement such as to tighten a nut or bolt, for instance.

The ratchet device 13 has a form which generally coincides with the form of the ratchet chamber 26, although its width will be smaller than the space between the ratchet wheel[14]/and the mutually opposing walls 33, 34 of the ratchet chamber. By causing the ratchet device 13 to adopt a laterally displaced position with the aid of the spring crank 11, the ratchet device will function as a wedge between the ratchet wheel 14 and the wall (33 in FIG. 8) against which it is displaced by the crank 11 when the fitter rotates the wrench in this direction, as illustrated in FIG. 8B. This wedging action locks the handle to the ratchet wheel 14, thereby forcing the mechanism 19 to accompany rotation in this direction. When the handle 2 is turned in the opposite direction, the direction shown by the arrow P1 in FIG. 8A, the ratchet device 13 is released from its wedging action with the ratchet wheel 14 and moves against the two walls 33, 34 of the ratchet chamber 26, as shown in FIG. 8A.

When the spring crank 11 is adjusted to its end position opposite to that shown in FIG. 8, there is, of course, obtained an opposite function in the two directions of handle[2]/rotation. In this case, the wedging action between the ratchet device 13, the ratchet wheel 14 and the walls 34 of the ratchet chamber 26 is achieved when the handle 2 is rotated or turned in the direction of the arrow P1, resulting in force transmission to the mechanism 19. When the handle 2 is turned in the opposite direction, the handle moves freely without moving the mechanism 19.

In order to obtain an improved wedging function with subsequent improvement of force transference to the ratchet wheel 14, the ratchet device 13 preferably comprises a generally kidney-shaped body which is movably arranged in the ratchet chamber 26. The concave side of the kidney-shaped body 13 facing towards the ratchet wheel 14 is provided with a toothed ring 27 which corresponds to the teeth 18 of the ratchet wheel 14. The concave surface of the body 13 has a radius of curvature which corresponds to the radius of the ratchet wheel 14. The sides of the body 13 facing towards the handle 2 have a radius of curvature which coincides with the convex radius of curvature of the body 13, which towards both ends of the body 13 merges with a respective inwardly angled straight line.

As will be evident from the aforegoing, it is not necessary to provide the ratchet wheel 14 and the ratchet body 13 with teeth, even though this is to be preferred. Furthermore, the ratchet wrench can be modified in other respects without departing from the inventive concept. For example, the ratchet body 13 and the ratchet chamber 26 can be given other configurations than that illustrated, without excluding the desired wedging effect. Another example of possible modification is that the resetting sleeve 3 can be caused to move axially instead of rotationally as in the aforedescribed case. In the case of an axially movable sleeve 3, the sleeve would cause the ratchet spring 1 to snap over from one to the other of the positionally defined spaces 30 and 31, through the medium of a Z-shaped slot in the sleeve attachment device 23. Other modifications are conceivable within the scope of the inventive concept, and consequently the invention cannot be considered restricted to the aforedescribed and illustrated embodiment, but all alternative solutions and modifications are embraced by the scope of the following claims.

What is claimed is:

1. A ratchet wrench comprising:

a handle;

a head fixed to one end of the handle;

a rotatable mechanism received in said head;

a ratchet device received in said head adjacent said rotatable mechanism and operable to control the direction of rotation of said rotatable mechanism;

a hand grip having a gripping surface said hand grip fixed to the other end of the handle;

a resetting sleeve having an annular shape, said resetting sleeve rotatably mounted on the hand; and an operating element operably connected to said resetting sleeve and said ratchet device whereby rotation of said resetting sleeve operates said ratchet device to reset the rotation direction of said rotatable mechanism, said resetting sleeve being located adjacent the gripping surface.

2. A ratchet wrench comprising:

a handle;

a head fixed to a first end of said handle;

a ratchet wheel received by said head;

a ratchet device associated with said ratchet wheel, said ratchet device being actuable from a first position in which said ratchet wheel is allowed to rotate in a first direction and prevented from rotating in a second direction to a second position in which said ratchet wheel is allowed to rotate in said second direction and prevented from rotating in said first direction;

a hand grip defining a gripping surface fixed to a second end of said handle;

a resetting sleeve having an annular shape rotatably received on said handle between said gripping surface and said head; and an operating element coupling said resetting sleeve and said ratchet device such that rotation of said resetting sleeve in one direction causes said operating element to bias said ratchet device toward said first position and rotation of said resetting sleeve in said other direction causes said operating element to bias said ratchet device toward said second position.

3. A ratchet wrench in accordance with claim 3 in which said operating element is received within said handle.

4. A ratchet wrench in accordance with claim 3 in which said operating element comprises a ratchet spring having a first end engaging said ratchet device and a second end engaging said resetting sleeve.

5. A ratchet wrench in accordance with claim 4 in which said ratchet spring has a mid portion defining a first axis, said first end having an eccentric crank portion offset from aid first axis, said crank portion engaging said ratchet device.

6. A ratchet wrench in accordance with claim 5 in which rotation of said resetting sleeve causes said ratchet spring to rotate about said first axis to thereby cause said crank portion of said first end to move said ratchet device selectively toward said first or second position depending on the direction of rotation.

7. A ratchet wrench of claim 6 in which said handle defines an operating chamber having a shoulder with first and second sides, said second end of said ratchet spring being positioned within said operating chamber, said second end of said ratchet spring being provided with first and second legs, said first leg being offset from said first axis and having a portion for engaging said first side of said shoulder to maintain said ratchet device in said first position and said second side of said shoulder to maintain said ratchet device in said second position, and said second leg engaging said resetting sleeve such that rotation of said resetting sleeve in one direction causes said first leg to move from said first side of said shoulder to said second side of said shoulder and rotation of said resetting sleeve in the other direction causes said first leg to move from said second side of said shoulder to said first side of said shoulder.

8. A ratchet wrench in accordance with claim 2 in which said head defines a ratchet chamber.

9. A ratchet wrench in accordance with claim 8 in which said ratchet chamber is crescent shaped with said convex side of said crescent being defined by said walls of said ratchet chamber and said concave side of said chamber being defined by said ratchet wheel.

10. A ratchet wrench in accordance with claim 9 wherein said circumference of said ratchet wheel is provided with a plurality of teeth and wherein said ratchet device having a radius of curvature corresponding to said radius of said ratchet wheel and being provided with a plurality of teeth sized to engage said teeth on said ratchet wheel.

11. A ratchet wrench in accordance with claim 10 wherein said ratchet device in said first position is wedged into a first corner of said ratchet chamber with said teeth of said ratchet device engaging said teeth of said ratchet wheel such that rotation of said ratchet wheel in said second direction is prevented by the engagement of said ratchet device with said wall of said ratchet chamber and rotation of said ratchet wheel in said first direction overcomes the forces of said operating element to move said ratchet device away from said ratchet chamber wall and disengage said teeth of said ratchet wheel from said teeth of said ratchet device to allow said ratchet wheel to rotate freely in said first direction and wherein said ratchet device in said second position is wedge into a second corner of said ratchet wheel in said first direction is prevented by said engagement of said ratchet device with said wall of said ratchet chamber and rotation of said ratchet wheel in said second direction overcomes said forces of said operating element to move said ratchet device away from said ratchet chamber wall and disengage said teeth of said ratchet wheel from said teeth of said ratchet device to allow said ratchet wheel to rotate freely in said second direction.

* * * * *

UNITED STATES PATENT AND TRADEMARK OFFICE

CERTIFICATE OF CORRECTION

PATENT NO. : 5,230,262

DATED : July 27, 1993

INVENTOR(S) : Bengt Ahlund et al.

It is certified that error appears in the above-indentified patent and that said Letters Patent is hereby corrected as shown below:

On the Title Page, item 57, Line 12 "15" should read -- --

Column 6, line 56, "hand" should read --handle--
Column 6, line 58, "device" should read --element--
Column 7, line 20, "claim 3" should read --claim 2--
Column 7, line 30 "aid" should read --said--
Column 7, line 38, "A" should read --The--
Column 8, line 9, "chamber." should read --chamber, said ratchet device being positioned in said ratchet chamber.--
Column 8, line 18, "device having" should read --device is kidney shaped, said concave side of said ratchet device having--
Column 8, line 30, "forces" should read --force--
Column 8, line 36, "wedge" should read --wedged--
Column 8, line 36 "ratchet wheel" should read --ratchet chamber with said teeth of said ratchet device engaging said teeth of said ratchet wheel such that rotation of said--
Column 8, line 40, "forces" should read --force--

Signed and Sealed this

Second Day of August, 1994

Bruce Lehman

*Attest:*

BRUCE LEHMAN

*Attesting Officer*

*Commissioner of Patents and Trademarks*